US005472875A

United States Patent [19]

Monticello

[11] Patent Number: 5,472,875

[45] Date of Patent: Dec. 5, 1995

[54] CONTINUOUS PROCESS FOR BIOCATALYTIC DESULFURIZATION OF SULFUR-BEARING HETEROCYCLIC MOLECULES

[75] Inventor: Daniel J. Monticello, Elkhart, Ind.

[73] Assignee: Energy BioSystems Corporation, The Woodlands, Tex.

[21] Appl. No.: 134,742

[22] Filed: Oct. 12, 1993

Related U.S. Application Data

[63] Continuation-in-part of Ser. No. 694,530, May 1, 1991, abandoned.

[51] Int. Cl.[6] ..... C10G 32/00; C10G 29/20; C02F 3/00; C02F 3/02

[52] U.S. Cl. ..... 435/282; 435/281; 210/601; 210/624; 208/237

[58] Field of Search ..... 435/282, 281; 210/601, 620, 621, 622, 624, 909; 208/237

[56] References Cited

U.S. PATENT DOCUMENTS

| | | | |
|---|---|---|---|
| 2,521,761 | 9/1950 | Strawinski | 195/3 |
| 2,574,070 | 11/1951 | Strawinski | 195/3 |
| 2,641,564 | 6/1953 | Zobell | 195/3 |
| 2,975,103 | 3/1961 | Kirshenbaum | 195/3 |
| 3,069,325 | 12/1962 | Hitzman | 195/3 |
| 3,305,353 | 2/1967 | Duncan et al. | 75/101 |
| 4,206,288 | 6/1980 | Detz et al. | 435/267 |
| 4,283,270 | 8/1981 | McHale | 208/50 |
| 4,562,156 | 12/1985 | Isbister et al. | 435/253 |
| 4,618,348 | 10/1986 | Hayes et al. | 44/51 |
| 4,632,906 | 12/1986 | Kopacz | 435/282 |
| 4,659,670 | 4/1987 | Stevens, Jr. et al. | 435/262 |
| 4,703,010 | 10/1987 | Yunker et al. | 435/173 |
| 4,757,833 | 7/1988 | Danley | 137/13 |
| 4,808,535 | 2/1989 | Isbister | 435/252.1 |
| 4,851,350 | 7/1989 | Stevens, Jr. et al. | 435/262 |
| 4,861,723 | 8/1989 | Madgavkar | 435/262 |
| 4,954,229 | 9/1990 | Kim et al. | 204/130 |
| 5,002,888 | 3/1991 | Kilbane, II | 435/252.31 |
| 5,094,668 | 3/1992 | Kern et al. | 44/622 |
| 5,104,801 | 4/1992 | Kilbane, II | 435/282 |
| 5,132,219 | 7/1992 | Kilbane, II | 435/195 |
| 5,198,341 | 3/1993 | Kilbane, II | 435/42 |
| 5,232,854 | 8/1993 | Monticello | 435/282 |
| 5,344,778 | 9/1994 | Kilbane | 435/262 |
| 5,356,801 | 10/1994 | Rambosek et al. | 435/195 |
| 5,356,813 | 10/1994 | Monticello | 435/282 |
| 5,358,870 | 10/1994 | Monticello | 435/282 |

FOREIGN PATENT DOCUMENTS

| | | |
|---|---|---|
| 0401922 | 12/1990 | European Pat. Off. . |
| 9209706 | 6/1992 | WIPO . |

OTHER PUBLICATIONS

Marquis et al. "Microbial Oxidation of Sulfur in debenzothiophene" *Resonance, Conservation and Recycling* vol. 5 (1991) pp. 255–263.

Dordick et al. "Enzymstis Catalysis on Cond–Related Compounds" *Resonances, Convervation and Recycling* vol. 5 (1991) pp. 195–209.

(List continued on next page.)

*Primary Examiner*—Michael G. Wityshyn
*Assistant Examiner*—Timothy J. Reardon
*Attorney, Agent, or Firm*—Hamilton, Brook, Smith & Reynolds

[57] ABSTRACT

A continuous cyclic process for desulfurizing a petroleum liquid which contains organic sulfur molecules, a significant portion of which are comprised of sulfur-bearing heterocycles. This process involves oxygenating the petroleum liquid and treating it with a biocatalyst capable of catalyzing the sulfur-specific oxidative cleavage of organic carbon-sulfur bonds in sulfur-bearing aromatic heterocyclic molecules such as dibenzothiophene. a particularly preferred biocatalyst is a culture of mutant *Rhodococcous rhodocrous* bacteria, ATCC No. 53968. In the present process, the activity of this biocatalyst is regenerated; it can be used for many cycles of treatment. A system for conducting the continuous cyclic process of biocatalytic desulfurization of petroleum liquids is also disclosed.

36 Claims, 2 Drawing Sheets

OTHER PUBLICATIONS

Gary, James H. and Handwerk, Glenn E., "Hydrotreating," in *Petroleum Refining Technology and Economics* (NY: Marcel Dekker, Inc.), pp. 114–120 (1975).

Speight, J. G. "The Hydrodesulfurization Process," in *The Desulfurization of Heavy Oils and Residue* (NY: Marcel Dekker, Inc.), pp. 119–127 (1981).

Gundlach, E. R. eta l., "The Fate of *Amoco Cadiz* Oil" Science, 221:122–129 (1983).

Hartdegen, F. J. et al., "Microbial Desulfurization of Petroleum," *Chem. Eng. Progress* 80(5):63–67, (1984).

Monticello, D. J. and Finnerty, W. R., "Microbial Desulfurization of Fossil Fuels," *Ann. Rev. Microbiol.* 39:371–389 (1985).

Shih, S. S. et al., "Deep Desulfurization of Distillate Components," Paper presented at the 1990 AIChE Chicago Annual Meeting, Session #264, (Paper 264B) Chicago, Ill. (1990), Nov.

Kilbane, John J., II, "Sulfur–Specific Microbial Metabolism of Organic Compounds," *Resources, Conservation and Recycling* 3:69–79 (1990).

Monticello, Daniel J. and Kilbane, John J., "Practical Considerations in Biodesulfurization of Petroleum," presented at IGT's Third International Symposium on Gas, Oil, Coal and Environmental Biotechnology, New Orleans, La., (1990), Dec.

Lee, K–I. et al., "Sulfur Removal from Coal Through Multiphase Media Containing Biocatalysts," *J. Chem. Tech. Biotecchnol.* 48:71–79, (1990).

Kilbane, J. J. "Desulfurization of coal: the microbial solution," *Trends in Biotechnology* 7(4):97–101, (1989).

Kargi, Fikret and Robinson, James M., "Microbial Oxidation of Dibenzothiophene by the Thermophilic Organism Sulfolobus acidocaldarius," *Biotechnology and Bioengineering* 26:687–690.

Isbister, J. D. and Kobylinski, E. A., "Microbial Desulfurization of Coal," presented at The First International Conference on Processing and Utilization of High Sulfur Coals, Columbus, OH (1985) Oct.

Kilbane, J. J., "Biodesulfurization: Future Prospects in Coal Cleaning," presented at Seventh Annual International Pittsburg Coal Conference, Pittsburgh, Pa. (1990) Sep.

Kilbane, J. J., "Biodesulfurization of Coal," presented at the IGT Symposium On Gas, Oil and Coal Biotechnology, New Orleans, La., (1988) Dec.

CONTINUOUS PROCESS FOR BIOCATALYTIC DESULFURIZATION OF SULFUR-BEARING HETEROCYCLIC MOLECULES

RELATED APPLICATIONS

The following application is a continuation-in-part of copending U.S. Ser. No. 07/694,530, filed May 1, 1991, now abandoned, the teachings of which are hereby incorporated by reference.

BACKGROUND

Sulfur is an objectionable element which is nearly ubiquitous in fossil fuels, where it occurs both as inorganic (e.g., pyritic) sulfur and as organic sulfur (e.g., a sulfur atom or moiety present in a wide variety of hydrocarbon molecules, including for example, mercaptans, disulfides, sulfones, thiols, thioethers, thiophenes, and other more complex forms). Organic sulfur can account for close to 100% of the total sulfur content of petroleum liquids, such as crude oil and many petroleum distillate fractions. Crude oils can typically range from close to about 5 wt % down to about 0.1 wt % organic sulfur. Those obtained from the Persian Gulf area and from Venezuela (Cerro Negro) can be particularly high in organic sulfur content. Monticello, D. J. and J. J. Kilbane, "Practical Considerations in Biodesulfurization of Petroleum" *IGT's 3rd Intl. Symp. on Gas, Oil, Coal, and Env. Biotech.*, (Dec. 3–5, 1990) New Orleans, La., and Monticello, D. J. and W. R. Finnerty, (1985) *Ann. Rev. Microbiol.* 39:371–389.

The presence of sulfur has been correlated with the corrosion of pipeline, pumping, and refining equipment, and with premature breakdown of combustion engines. Sulfur also contaminates or poisons many catalysts which are used in the refining and combustion of fossil fuels. Moreover, the atmospheric emission of sulfur combustion products such as sulfur dioxide leads to the form of acid deposition known as acid rain. Acid rain has lasting deleterious effects on aquatic and forest ecosystems, as well as on agricultural areas located downwind of combustion facilities. Monticello, D. J. and W. R. Finnerty, (1985) *Ann. Rev. Microbiol.* 39:371–389. To combat these problems, several methods for desulfurizing fossil fuels, either prior to or immediately after combustion, have been developed.

One technique which is employed for pre-combustion sulfur removal is hydrodesulfurization (HDS). This approach involves reacting the sulfur-containing fossil fuel with hydrogen gas in the presence of a catalyst, commonly a cobalt- or molybdenum-aluminum oxide or a combination thereof, under conditions of elevated temperature and pressure. HDS is more particularly described in Shih, S. S. et al., "Deep Desulfurization of Distillate Components", Abstract No. 264B AIChE Chicago Annual Meeting, presented Nov. 12, 1990, (complete text available upon request from the American Institute of Chemical Engineers; hereinafter Shih et al.), Gary, J. H. and G. E. Handwerk, (1975) *Petroleum Refining: Technology and Economics*, Marcel Dekker, Inc., N.Y., pp. 114–120, and Speight, J. G., (1981) *The Desulfurization of Heavy Oils and Residue*, Marcel Dekker, Inc., N.Y., pp. 119–127. HDS is based on the reductive conversion of organic sulfur into hydrogen sulfide ($H_2S$), a corrosive gaseous product which is removed from the fossil fuel by stripping. Elevated or persistent levels of hydrogen sulfide are known to inactivate or poison the chemical HDS catalyst, complicating the desulfurization of high-sulfur fossil fuels.

Moreover, the efficacy of HDS treatment for particular types of fossil fuels varies due to the wide chemical diversity of hydrocarbon molecules which can contain sulfur atoms or moieties. Some classes of organic sulfur molecules are labile and can be readily desulfurized by HDS; other classes are refractory and resist desulfurization by HDS treatment. The classes of organic molecules which are often labile to HDS treatment include mercaptans, thioethers, and disulfides. Conversely, the aromatic sulfur-bearing heterocycles (i.e., aromatic molecules bearing one or more sulfur atoms in the aromatic ring itself) are the major class of HDS-refractory organic sulfur-containing molecules. Typically, the HDS-mediated desulfurization of these refractory molecules proceeds only at temperatures and pressures so extreme that valuable hydrocarbons in the fossil fuel can be destroyed in the process. Shih et al.

Recognizing these and other shortcomings of HDS, many investigators have pursued the development of commercially viable techniques of microbial desulfurization (MDS). MDS is generally described as the harnessing of metabolic processes of suitable bacteria to the desulfurization of fossil fuels. Thus, MDS typically involves mild (e.g., physiological) conditions, and does not involve the extremes of temperature and pressure required for HDS. Additionally, the ability of a biological desulfurizing agent to renew or replenish itself is viewed as a potentially significant advantage over physicochemical catalysis.

The discovery that certain species of chemolithotrophic bacteria, most notably *Thiobacillus ferrooxidans*, obtain the energy required for their metabolic processes from the oxidation of pyritic (inorganic) sulfur into water-soluble sulfate has stimulated the search for an MDS technique for the desulfurization of coal, in which pyritic sulfur can account for more than half of the total sulfur present. Recently, Madgavkar, A. M. (1989) U.S. Pat. No. 4,861,723, has proposed a continuous *T. ferrooxidans*—based MDS method for desulfurizing coal. However, a commercially viable MDS process for the desulfurization of coal has not yet emerged.

Because of the inherent specificity of biological systems, *T. ferooxidans* MDS is limited to the desulfurization of fossil fuels in which inorganic sulfur, rather than organic sulfur, predominates. Progress in the development of an MDS technique appropriate for the desulfurization of fossil fuels in which organic sulfur predominates has not been as encouraging. Several species of bacteria have been reported to be capable of catabolizing the breakdown of sulfur-containing hydrocarbon molecules into water-soluble sulfur products. One early report describes a cyclic desulfurization process employing *Thiobacillus thiooxidans, Thiophyso volutans*, or *Thiobacillus thioparus* as the microbial agent. Kirshenbaum, I., (1961) U.S. Pat. No. 2,975,103. More recently, Monticello, D. J. and W. R. Finnerty, (1985) *Ann. Rev. Microbiol.* 39:371–389, and Hartdegan, F. J. et al., (May 1984) *Chem. Eng. Progress* 63–67, have reported that such catabolic desulfurization of organic molecules is, for the most part, merely incident to the utilization of the hydrocarbon portion of these molecules as a carbon source, rather than a sulfur-selective or -specific phenomenon. Moreover, catabolic MDS proceeds most readily on the classes of organic sulfur molecules described above as labile to HDS.

Although Monticello and Finnerty report that several species of bacteria have been described as capable of desulfurizing the HDS-refractory aromatic sulfur-bearing heterocycles, in particular *Pseudomonas putida* and *P. alcaligenes*, this catabolic pathway is also merely incident to the utilization of the molecules as a carbon source. Consequently, valuable combustible hydrocarbons are lost, and frequently the water-soluble sulfur products generated from the catabolism of sulfur-bearing heterocycles are small organic molecules rather than inorganic sulfur ions. As a result, the authors conclude that the commercial viability of these MDS processes is limited. Monticello, D. J. and W. R. Finnerty, (1985) *Ann. Rev. Microbiol.* 39:371–389.

None of the above-described desulfurization technologies provides a viable means for liberating sulfur from refractory organic molecules, such as the sulfur-bearing heterocycles. The interests of those actively engaged in the refining and manufacturing of petroleum fuel products have accordingly become focused on the need to identify such a desulfurization method, in view of the prevalence of these refractory molecules in crude oils derived from such diverse locations as the Middle East (about 40% of the total organic sulfur content present in aromatic sulfur-bearing heterocycles) and West Texas (up to about 70% of the total).

SUMMARY OF THE INVENTION

This invention relates to a continuous process for desulfurizing a petroleum liquid which contains organic sulfur molecules, a significant portion of which are comprised of sulfur-bearing heterocycles, comprising the steps of: (a) contacting the petroleum liquid with a source of oxygen under conditions sufficient to increase the oxygen tension in the petroleum liquid to a level at which the biocatalytic oxidative cleavage of carbon-sulfur bonds in sulfur-bearing heterocycles proceeds; (b) introducing the oxygenated petroleum liquid to a reaction vessel while simultaneously introducing an aqueous, sulfur-depleted biocatalytic agent to the reaction vessel, the agent being capable of inducing the selective oxidative cleavage of carbon-sulfur bonds in sulfur-bearing heterocycles; (c) incubating the oxygenated petroleum liquid with the biocatalytic agent in the reaction vessel under conditions sufficient for biocatalytic oxidative cleavage of said carbon-sulfur bonds, for a period of time sufficient for a significant number of cleavage reactions to occur, whereby the organic sulfur content of the treated petroleum liquid is significantly reduced and a significant amount of water-soluble inorganic sulfate is generated; (d) removing the desulfurized petroleum liquid from the reaction vessel; (e) retrieving the spent aqueous biocatalytic agent from the reaction vessel, the spent agent being significantly enriched in inorganic sulfate; (f) treating the sulfate-enriched spent aqueous biocatalytic agent in a manner sufficient for the removal of a substantial amount of inorganic sulfate from the agent, whereby the biocatalytic activity of the agent is regenerated; and (g) reintroducing the regenerated aqueous biocatalytic agent to the reaction vessel while simultaneously introducing a petroleum liquid in need of biocatalytic desulfurization.

This invention further relates to a continuous process for desulfurizing a liquid fossil fuel which contains organic sulfur molecules, a significant portion of which are sulfur-bearing heterocycles, comprising the steps of: (a) contacting the liquid fossil fuel with a source of oxygen under conditions sufficient to increase the oxygen tension in the liquid fossil fuel; (b) introducing the oxygenated liquid fossil fuel to a vertically elongated reaction vessel having means to collect and decant organic liquid from an upper region and means to remove an aqueous liquid from a lower region, while simultaneously introducing an aqueous, sulfur-deprived biocatalytic agent to the reaction vessel at a site spatially distinct from the site of introduction of the liquid fossil fuel, in such a fashion as to create a countercurrent flow system within the vessel, the agent comprising one or more microbial organisms expressing an enzyme that catalyzes the sulfur-specific oxidative cleavage of heterocyclic aromatic rings in sulfur-bearing heterocycles to produce desulfurized organic molecules and inorganic sulfur ions, enzymes derived from such microbial organisms, or mixtures of such microbial organisms and enzymes, the establishment of countercurrent flow providing sufficient mixing between the liquid fossil fuel and the aqueous biocatalyst for a significant number of carbon-sulfur bonds to be biocatalytically cleaved within a reasonable period of time; (c) incubating the oxygenated liquid fossil fuel with the biocatalytic agent in the reaction vessel under conditions sufficient for biocatalytic oxidative cleavage of said carbon-sulfur bonds, whereby the organic sulfur content of the treated liquid fossil fuel is significantly reduced and a significant amount of water-soluble inorganic sulfur is generated; (d) removing the liquid fossil fuel from the reaction vessel by decanting it from the upper region of the vessel; (e) removing the spent aqueous biocatalytic agent from the reaction vessel by recovering it from the lower region of the vessel, the spent agent being significantly enriched in inorganic sulfur; (f) treating the inorganic sulfur-enriched aqueous biocatalytic agent in a manner sufficient for the removal of a substantial amount of inorganic sulfur from the agent, whereby the biocatalytic activity of the agent is regenerated; and (g) introducing regenerated aqueous biocatalytic agent to the reaction vessel while simultaneously introducing thereto a liquid fossil fuel in need of biocatalytic desulfurization, in such a fashion as to maintain countercurrent flow.

In a preferred embodiment of the invention, the biocatalytic agent comprises a culture of mutant *Rhodococcus rhodocrous* bacteria, ATCC No. 53968. This microbial biocatalyst is particularly advantageous in that it is capable of catalyzing the selective liberation of sulfur from HDS-refractory sulfur-bearing aromatic heterocycles, under mild conditions of temperature and pressure. Therefore, even crude oils or petroleum distillate fractions containing a high relative abundance of refractory organic sulfur-bearing molecules can be desulfurized without exposure to conditions harsh enough to degrade valuable hydrocarbons. Additionally, the biocatalyst is regenerated and reused in the continuous method described herein; it can be used for many cycles of biocatalytic desulfurization. Moreover, the method and process of the instant invention can be readily integrated into existing petroleum refining or processing facilities.

DETAILED DESCRIPTION OF THE INVENTION

This invention employs a biocatalytic agent which is capable of selectively liberating sulfur from the classes of organic sulfur molecules which are most refractory to current techniques of desulfurization, such as HDS. The instant biocatalytic agent is used in a continuous process for desulfurizing a petroleum liquid containing organic sulfur molecules, a significant proportion of which are comprised of sulfur-bearing heterocycles. These HDS-refractory molecules occur in simple one-ring forms (e.g., thiophene), or more complex multiple condensed-ring forms. The difficulty of desulfurization through conventional techniques increases with the complexity of the molecule.

Figure 1:
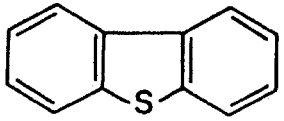
FIG. 1 is a schematic illustration of the structural formula of dibenzothiophene, a model HDS-refractory sulfur-bearing heterocycle.

The tripartite condensed-ring sulfur-bearing heterocycle dibenzothiophene (DBT), shown in FIG. 1, is particularly refractory to HDS treatment, and therefore can constitute a major fraction of the residual post-HDS sulfur in fuel products. Alkyl-substituted DBT derivatives are even more refractory to HDS treatment, and cannot be removed even by repeated HDS processing under increasingly severe conditions. Shih et al. Moreover, as noted above, DBTs can account for a significant percentage of the total organic sulfur in certain crude oils. Therefore, DBT is viewed as a model refractory sulfur-bearing molecule in the development of new desulfurization methods. Monticello, D. J. and W. R. Finnerty, (1985) *Ann. Rev. Microbiol.* 39:371–389. No naturally occurring bacteria or other microbial organisms have yet been identified which are capable of effectively degrading or desulfurizing DBT. Thus, when released into the environment, DBT and related complex heterocycles tend to persist for long periods of time and are not significantly biodegraded. Gundlach, E. R. et al., (1983) *Science* 221:122–129.

Figure 2:
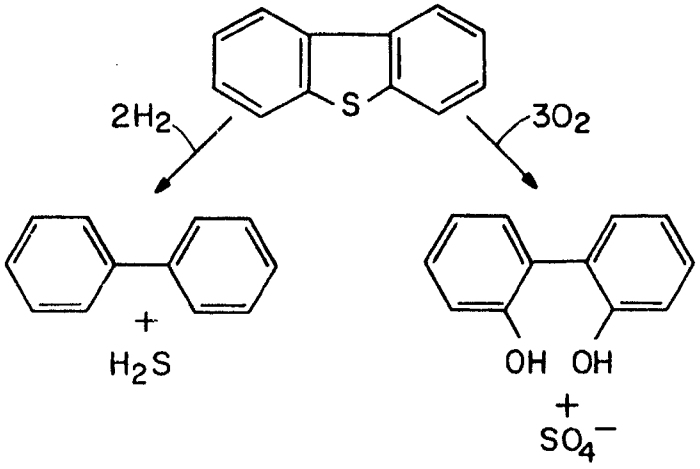
FIG. 2 is a schematic illustration of the cleavage of dibenzothiophene by oxidative and reductive pathways, and the end products thereof.

However, several investigators have reported the genetic modification of naturally-occurring bacteria into mutant strains capable of catabolizing DBT. Kilbane, J. J., (1990) *Resour. Cons. Recycl.* 3:69–79, Isbister, J. D., and R. C. Doyle, (1985) U.S. Pat. No. 4,562,156, and Hartdegan, F. J. et al., (May 1984) *Chem. Eng. Progress* 63–67. For the most part, these mutants desulfurize DBT nonspecifically, and release sulfur in the form of small organic sulfur breakdown products. Thus, a portion of the fuel value of DBT is lost through this microbial action. Isbister and Doyle reported the derivation of a mutant strain of Pseudomonas which appeared to be capable of selectively liberating sulfur from DBT, but did not elucidate the mechanism responsible for this reactivity. As shown in FIG. 2, there are at least two possible pathways which result in the specific release of sulfur from DBT: oxidative and reductive.

Figure 3:
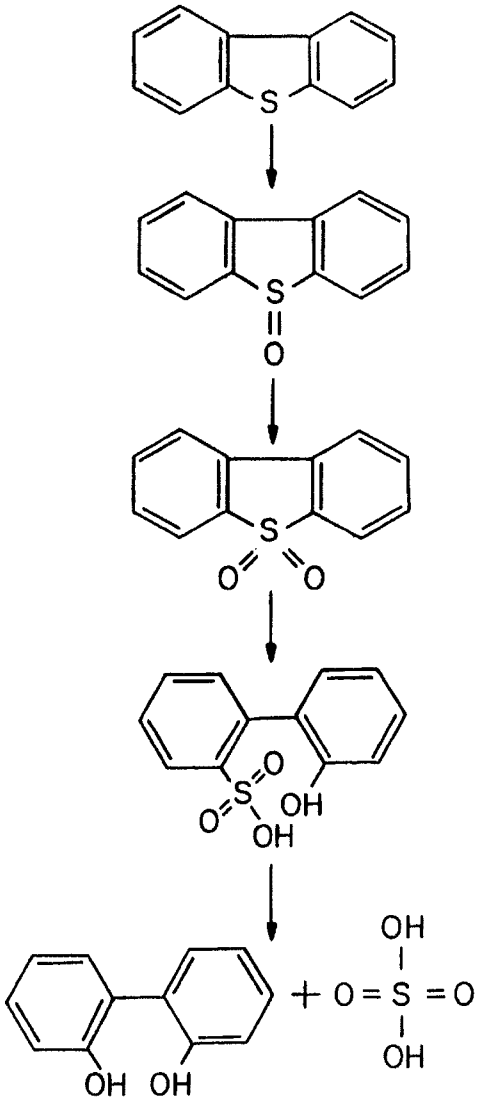
FIG. 3 is a schematic illustration of the stepwise oxidation of dibenzothiophene along the proposed "4S" pathway of microbial catabolism.

Kilbane recently reported the mutagenesis of a mixed bacterial culture, producing one which appeared capable of selectively liberating sulfur from DBT by the oxidative pathway. This culture was composed of bacteria obtained from natural sources such as sewage sludge, petroleum refinery wastewater, garden soil, coal tar-contaminated soil, etc., and maintained in culture under conditions of continuous sulfur deprivation in the presence of DBT. The culture was then exposed to the chemical mutagen 1-methyl-3-nitro-1-nitrosoguanidine. The major catabolic product of DBT metabolism by this mutant culture was hydroxybiphenyl; sulfur was released as inorganic water-soluble sulfate, and the hydrocarbon portion of the molecule remained essentially intact. Based upon these results, Kilbane proposed that the "4S" catabolic pathway summarized in FIG. 3 was the mechanism by which these products were generated. The designation "4S" refers to the reactive sulfur intermediates of the proposed pathway: DBT-sulfoxide, DBT-sulfone, DBT-sulfonate, and the liberated product, inorganic sulfate. The hydrocarbon portion of the DBT molecule remains essentially intact; in FIG. 3, the theoretical hydrocarbon product, dihydroxybiphenyl is shown. In practice, monohydroxybiphenyl is also observed. Kilbane, J. J., (1990) *Resour. Cons. Recycl.* 3:69–79, the teachings of which are incorporated herein by reference.

Subsequently, Kilbane has isolated a mutant strain of *Rhodococcus rhodocrous* from this mixed bacterial culture. This mutant, ATCC No. 53968, is a particularly preferred biocatalytic agent for use with the instant method of continuous biocatalytic desulfurization. The isolation and characteristics of this mutant are described in detail in J. J. Kilbane, U.S. Pat. No. 5,104,801, the teachings of which are incorporated herein by reference. This microorganism has been deposited on Nov. 28, 1989 at the American type Culture Collection (ATCC), 12301 Park Lawn Drive, Rockville, Md., U.S.A. 20852 under the terms of the Budapest Treaty, and has been designated as ATCC Deposit No. 53968. One suitable ATCC No. 53968 biocatalyst preparation is a culture of the living microorganisms, prepared generally as described in U.S. Pat. No. 5,104,801 and in prior U.S. patent application, Ser. No. 07/631,642 now abandoned. Intact heat-killed ATCC No. 53968 microorganisms can also be used, as can cell-free enzyme preparations obtained from ATCC No. 53968 generally as described in U.S. Pat. No. 5,132,219 and in pending U.S. patent application, Ser. No. 07/897,314 now U.S. Pat. No. 5,358,870. In the instant method for biocatalytic desulfurization (BDS), the ATCC No. 53968 biocatalytic agent is employed in a continuous desulfurization process for the treatment of a petroleum liquid in which HDS-refractory organic sulfur molecules, such as the aromatic sulfur-bearing heterocycles, constitute a significant portion of the total organic sulfur content.

Biocatalytic conversion of sulfur-bearing heterocycles into molecules that are not substituted by sulfur can proceed via a reductive (anaerobic) pathway, such that molecules similar to biphenyl (FIG. 2 are produced. Thus, preparations of the microorganism disclosed by Kim et al. (1990), *Degradation of organic sulfur compounds and the reduction of dibenzothiophene to biphenyl and hydrogen sulfide by Desulfovibrio desulfuricans M6*, 12 BIOTECH. LETT. (No. 10) 761–764, incorporated herein by reference can be used as a desulfurization biocatalyst in the present invention.

Preferably, an oxidative (aerobic) pathway can be followed. Examples of microorganisms that act by this oxidative pathway, preparations of which are suitable for use as the biocatalyst in the present invention include the microbial consortium (a mixture of several microorganisms) disclosed in Kilbane (1990), 3 RESOUR. CONSERV. RECYCL. 69–79, the microorganisms disclosed by Kilbane in U.S. Pat. Nos. 5,002,888 (issued Mar. 26, 1991), 5,104,801 (issued Apr. 14, 1992) [also described in Kilbane (1990), *Biodesulfurization: future prospects in coal cleaning*, in PROC, 7TH ANN. INT'L. PITTSBURGH COAL CONF. 373–382] , and 5,198,341 (issued Mar. 30, 1993); and by Omori et al. (1992), *Desulfurization of dibenzothiophene by Corynebacterium sp. strain SY1*, 58 APPL. ENV. MICROBIOL. (No. 3) 911–915, all incorporated herein by reference.

Each of the foregoing microorganisms can function as a biocatalyst in the present invention because each produces one or more enzymes (protein biocatalysts) that carry out the specific chemical reaction(s) by which sulfur is excised from refractory organosulfur compounds. Lehninger, PRINCIPLES OF BIOCHEMISTRY (Worth Publishers, Inc., 1982), p. 8–9; cf. Zobell in U.S. Pat. No. 2,641,564 (issued Jun. 9, 1953) and Kern et al. in U.S. Pat. No. 5,094,668 (issued Mar. 10, 1992). Mutational or genetically engineered derivatives of any of the foregoing microorganisms can also be used as the biocatalyst herein, provided that appropriate biocatalytic function is retained.

Additional microorganisms suitable for use as the biocatalyst or biocatalyst source in the desulfurization process now described can be derived from naturally occurring microorganisms by known techniques. As set forth above, these methods involve culturing preparations of microorganisms obtained from natural sources such as sewage sludge, petroleum refinery wastewater, garden soil, or coal tar-contaminated soil under selective culture conditions in which the microorganisms are grown in the presence of refractory organosulfur compounds such as sulfur-bearing heterocycles as the sole sulfur source; exposing the microbial preparation to chemical or physical mutagens; or a combination of these methods. Such techniques are recounted by Isbister and Doyle in U.S. Pat. No. 4,562,156 (issued Dec. 31, 1985); by Kilbane in 3 RESOUR. CONSERV. RECYCL. 69–79 (1990), U.S. Pat. Nos. 5,002,888, 5,104,801 and 5,198,341; and by Omori and coworkers in 58 APPL. ENV. MICROBIOL. (No. 3) 911–915 (1992), all incorporated by reference.

As explained above, enzymes are protein biocatalysts made by living cells. Enzymes promote, direct or facilitate the occurrence of a specific chemical reaction or series of reactions (referred to as a pathway) without themselves becoming consumed or altered as a result thereof. Enzymes can include one or more unmodified or post-translationally or synthetically modified polypeptide chains or fragments or portions thereof, coenzymes, cofactors, or coreactants which collectively carry out the desired reaction or series of reactions. The reaction or series of reactions relevant to the present invention culminates in the excision of sulfur from the hydrocarbon framework of a refractory organosulfur compound, such as a sulfur-bearing heterocycle. The hydrocarbon framework of the former refractory organosulfur compound remains substantially intact. Microorganisms or enzymes employed as biocatalysts in the present invention advantageously do not consume the hydrocarbon framework of the former refractory organosulfur compound as a carbon source for growth. As a result, the fuel value of substrate fossil fuels exposed to BDS treatment does not deteriorate.

Although living microorganisms (e.g., a culture) can be used as the biocatalyst herein, this is not required. In certain suitable microorganisms, including *Rhodococcus rhodocrous* ATCC No. 53968, the enzyme responsible for biocatalytic cleavage of carbon-sulfur bonds is present on the exterior surface (the cell envelope) of the intact microorganism. Thus, non-viable (e.g., heat-killed) microorganisms can be used as a carrier for an enzyme biocatalyst. Other biocatalytic enzyme preparations that are useful in the present invention include microbial lysates, extracts, fractions, subfractions, or purified products obtained by conventional means and capable of carrying out the desired biocatalytic function. Generally, such enzyme preparations are substantially free of intact microbial cells. Kilbane and Monticello disclose enzyme preparations that are suitable for use herein in U.S. Pat. No. 5,132,219 (issued Jul. 21, 1992), and in pending U.S. patent application Ser. No. 07/897,314 (filed Jun. 11, 1992), now U.S. Pat. No. 5,358,870. Rambosek et al. disclose additional enzyme preparations, engineered from *Rhodococcus rhodocrous* ATCC No. 53968 and suitable for use herein, in U.S. patent application Ser. No. 07/911,845 (filed Jul. 10, 1992), now abandoned. Enzyme biocatalyst preparations suitable for use herein can optionally be affixed to a solid support, e.g., a membrane, filter, polymeric resin, glass particles or beads, or ceramic particles or beads. The use of immobilized enzyme preparations facilitates the separation of the biocatalyst from the treated fossil fuel which has been depleted of refractory organosulfur compounds.

It is preferable to prepare a BDS-active suspension of lysed microorganisms, substantially free of intact cells. Any lysis process, whether conventional or adapted from conventional techniques, can be used, provided that the enzyme responsible for BDS reactivity remains functional. For example, the ATCC No. 53968 bacteria can be subjected to one or more freeze-thaw cycles, treated with a suitable detergent and/or chaotropic agent, processed using a French press, or, more preferably, can be sonicated by conventional means comprising the use of a bath or immersion probe sonicator and incubation on melting ice.

It is particularly preferred to prepare a substantially cell-free aqueous extract of the microbial source of BDS reactivity, wherein the extract contains a substantial proportion of the total BDS activity functionally expressed by the microorganism. In certain suitable microorganisms, the BDS reactive enzyme may be functionally expressed as a cell envelope-associated enzyme. In the case of the ATCC No. 53968 microorganism and its functional derivatives, it was previously disclosed in U.S. Ser. No. 07/486,597 now U.S. Pat. No. 5,132,219 that BDS activity appears to arise from an enzyme associated with the exterior cell membrane and/or cell wall of the intact bacterium.

A cell free extract suitable for use as biocatalyst in the present BDS method can be prepared according to standard techniques, such as centrifugal fractionation, ammonium sulfate fractionation, filtration, bioaffinity or immunoaffinity precipitation, gel permeation chromatography, liquid chromatography, high pressure liquid chromatography, reverse-phase liquid chromato-graphy, preparative electrophoresis, isoelectric focussing, and the like. For example, a centrifugal fractionation procedure, wherein it is shown that a substantial proportion of ATCC No. 53968 expressed BDS reactivity is associated with the "cell debris" fraction of sonicated, lysed bacterial cells. This fraction, which comprises fragments of cell walls and/or outer cell membranes, was obtained as a pellet following centrifugation of lysed ATCC No. 53968 cells for 5 minutes at 6,000 xg.

In another embodiment, recombinant enzymes can be employed. These enzymes can be prepared by methods known in the art, such as by complementation, as exemplified below.

Mutant strains of a *R. rhodochrous*, which are incapable of cleaving carbon-sulfur bonds, are produced by exposing a strain of *R. rhodochrous* to a mutagen to produce *R. rhodochrous* mutants. Suitable strains of *R. rhodochrous* include any strain of *R. rhodochrous* containing DNA which encodes a biocatalyst capable of selective cleavage of carbon-sulfur bonds, such as ATCC No. 53968 as reported in U.S. Pat. No. 5,104,801, the teachings of which are incorporated herein by reference. In one embodiment, the IGTS8 strain of *R. rhodochrous*, from Institute of Gas Technology (Chicago, Ill.) is used.

Suitable mutagens include radiation, such as ultraviolet radiation or chemical mutagens, such as N-methyl-N'-nitrosoguanidine (NTG), hydroxylamine, ethylmethane-sulphonate (EMS) and nitrous acid.

*R. rhodochrous* mutants are allowed to grow in an appropriate medium and screened for carbon-sulfur bond cleavage activity. Mutants without carbon-sulfur bond cleavage activity are labelled $CS^-$. Any method of screening which allows for an accurate detection of carbon-sulfur bond cleavage activity is suitable in the method of the present invention.

Suitable methods of screening for this activity include exposing the different mutants to carbon-sulfur bond containing molecules and measure carbon-sulfur bond cleavage. In a preferred embodiment, the mutants are exposed to DBT, whose breakdown product, 2-hydroxybiphenyl (2-HBP), fluoresces under short wave ultraviolet light. Other methods include gas and liquid chromatography, infrared and nuclear magnetic resonance spectra. See Kodama, et al., Applied and Environmental Microbiology, pages 911–915 (1992) and Kilbane and Bielaga, Final Report D.O.E. Contract No. DE-AC22-88PC8891 (1991). Once $CS^-$ mutants are identified and isolated, clones are propagated for further analysis.

Concurrent with the mutagenesis of one culture of *R. rhodochrous*, a second culture is maintained, *R. rhodochrous*, that expresses a substance with carbon-sulfur bond cleavage activity ($CS^+$). DNA is extracted from this organism. Various methods of DNA extraction are suitable for isolating the DNA of this organism. Suitable methods include phenol and chloroform extraction. See Maniatis et al., *Molecular Cloning, A Laboratory Manual,* 2d, Cold Spring Harbor Laboratory Press, page 16.54 (1989), herein referred to as Maniatis et al..

Once the DNA is extracted from *R. rhodochrous*, the DNA is cut into fragments of various kilobase lengths, collection of which makes up the DNA library. Various methods of fragmenting the DNA of *R. rhodochrous* to free the DNA of the present invention, may be used including enzymatic and mechanical methods. Any four-base recognition restriction endonuclease such as TaqI or Sau 3A is suitable for fragmenting the DNA. Suitable methods of fragmenting DNA can be found in Maniatis et al..

The various DNA fragments are inserted into several mutant clones of *R. rhodochrous*, with the purpose of isolating the fragment of DNA, which encodes a biocatalyst. The transformation of a previously $CS^-$ mutant cell to a $CS^+$ transformed cell is evidence that the inserted DNA fragment encodes a biocatalyst. Any method of inserting DNA into *R. rhodochrous* which allows for the uptake and expression of said fragment is suitable. In a preferred embodiment, electroporation is used to introduce the DNA fragment into *R. rhodochrous*. See Maniatis et al..

Once transformed mutant *R. rhodochrous* has been produced and identified, DNA fragment encoding the $CS^+$ biocatalyst can be identified and isolated. The encoded biocatalyst can then be produced using the isolated DNA in various methods well-known and readily available to those skilled in the art. In addition the isolated DNA can be sequenced and replicated by methods known by those skilled in the art (See Maniatis et al.).

DNA isolated by the above described method can be isolated from any organism which expresses a biocatalyst capable of selectively cleaving carbon-sulfur bonds in a sulfur-bearing hydrocarbon. They include *Bacillus sphaericus* ATCC No. 53969 as reported in U.S. Pat. No. 5,002,888, the teachings of which are incorporated herein by reference.

Other methods of isolating the DNA of the present invention, include variations on the rational used above. For example, it would be possible to randomly insert a $CS^-$ DNA plasmid into clones of a $CS^+$ strain of *R. rhodochrous*. DNA encoding a $CS^+$ biocatalyst could then be identified by screening for clones that have been transformed from $CS^+$ to $CS^-$.

The recombinant DNA molecule of the present invention is intended to encompass any DNA resulting from the insertion into its chain, by chemical or biological means, a gene encoding a biocatalyst capable of selectively cleaving carbon-sulfur bonds, said gene not originally present in that chain. Recombinant DNA includes any DNA created by procedures using restriction nucleases, nucleic acid hybridization, DNA cloning, DNA sequencing or any combination of the preceding. Methods of construction can be found in Maniatis et al., and in other methods known by those skilled in the art. The term "recombinant DNA", as used herein, is intended to encompass any DNA resulting from the insertion into the chain, by chemical or biological means, of a DNA not originally present in that chain.

Procedures for the construction of DNA plasmid vectors of the present invention include those described in Maniatis et al. and other methods known by those skilled in the art. Suitable plasmid vectors include pRF-29 and pRR-6. The term "DNA plasmid vector" is intended any replication competent vector which has the capability of having DNA inserted into it and, subsequently, the expression of that DNA insert by an appropriate host cell. In addition, the plasmid vector must be receptive to the insertion of a DNA plasmid containing the genes of the present invention where the gene encodes a biocatalyst which has the capability to selective cleave carbon-sulfur bonds. Procedures for the construction of DNA plasmid vectors include those described in Maniatis et al. and others known by those skilled in the art.

The plasmids of the present invention include any DNA fragment containing the genes of a DNA which encode a biocatalyst which has the capability to selective cleave carbon-sulfur bonds. The term "plasmid" is intended to encompass any DNA fragment. The DNA fragment should be transmittable to a host microorganism by transformation or conjugation. Procedures for the construction or extraction of DNA plasmids include those described in Maniatis et al. and others known by those skilled in the art.

The transformed microorganisms of the present invention can be created by various methods by those skilled in the art. For example, transfection electroporation as explained by Maniatis et al. can be used. By the term "microorganisms" or "organism" is intended any organism capable of the uptake and expression of foreign DNA, i.e., DNA not originally a part of the organism nuclear material. Suitable organisms may include Corynebacterium or Escherichia.

In the biocatalytic desulfurization stage of multistage deep desulfurization, the liquid fossil fuel containing sulfur-bearing heterocycles is combined with the biocatalyst preparation. The relative amounts of biocatalyst preparation and liquid fossil fuel can be adjusted to suit particular conditions, or to produce a particular level of residual sulfur in the treated, deeply desulfurized fossil fuel. The amount of biocatalyst preparation to be combined with a given quantity of liquid fossil fuel will reflect the nature, concentration and specific activity of the particular biocatalyst used, as well as the nature and relative abundance of inorganic and organic sulfur compounds present in the substrate fossil fuel and the degree of deep desulfurization sought or considered acceptable.

The specific activity of a given biocatalyst is a measure of its biocatalytic activity per unit mass. Thus, the specific activity of a particular biocatalyst depends on the nature or identity of the microorganism used or used as a source of biocatalytic enzymes, as well as the procedures used for preparing and/or storing the biocatalyst preparation. The concentration of a particular biocatalyst can be adjusted as desired for use in particular circumstances. For example, where a culture of living microorganisms (e.g., ATCC No.

53968) is used as the biocatalyst preparation, a suitable culture medium lacking a sulfur source other than sulfur-bearing heterocycles can be inoculated with suitable microorganisms and fermented until a desired culture density is reached. The resulting culture can be diluted with additional medium or another suitable buffer, or microbial cells present in the culture can be retrieved e.g., by centrifugation, and resuspended at a greater concentration than that of the original culture. The concentrations of non-viable microorganism and of enzyme biocatalyst preparations can be adjusted similarly. In this manner, appropriate volumes of biocatalyst preparations having predetermined specific activities and/or concentrations can be obtained.

BDS Treatment of a Typical Middle Distillate with a culture of living ATCC No. 53968 microorganisms A petroleum distillate fraction, similar in specific gravity and other properties to a typical middle distillate or a heavy atmospheric gas oil or a vacuum gas oil or the material from a delayed coker, having an initial sulfur content of 0.51 wt %, was treated with a preparation of *Rhodococcus rhodochrous* ATCC No. 53968. The biocatalyst preparation consisted of an inoculum of the bacteria in a basal salts medium, comprising:

| Component | Concentration |
|---|---|
| $Na_2HPO_4$ | 0.557% |
| $KH_2PO_4$ | 0.244% |
| $NH_4Cl$ | 0.2% |
| $MgCl_2.6H_2O$ | 0.02% |
| $MnCl_2.4H_2O$ | 0.0004% |
| $FeCl_3.6H_2O$ | 0.0001% |
| $CaCl_2$ | 0.0001% |
| glycerol | 10 μM |

The bacterial culture and the substrate petroleum distillate fraction were combined in the ratio of 50:1 (i.e., a final concentration of 2% substrate). The BDS stage of deep desulfurization was conducted in shake flasks with gentle agitation at ambient temperature for 7 days. Subsequent analysis of the treated distillate fraction revealed that the wt % sulfur had fallen to 0.20%, representing a 61% desulfurization of the substrate petroleum liquid. Characterization of the sample before and after BDS treatment by gas chromatography coupled to a sulfur-specific detector demonstrated that prior to treatment, the sample contained a broad spectrum of organosulfur compounds. Due to the action of the ATCC No. 53968 biocatalyst, the levels of a broad range of these molecules were reduced in the post-BDS sample, including sulfur-bearing heterocycles such as DBT and radical-decorated derivatives thereof.

These results demonstrate that samples enriched in sulfur-bearing heterocycles can be desulfurized using microorganism described herein.

Preparation of a cell-free biocatalyst from ATCC No. 53968; Use of same in BDS Treatment A culture of *R. rhodocrous* ATCC No. 53968 was prepared by standard fermentation methods, under aerobic conditions using the media listed above. Intact bacterial cells were disrupted or lysed by sonication using an MSE brand sonicator equipped with a 16 mm diameter probe. The progress of cell lysis was monitored by tracking the appearance of soluble proteins (using a standard Bradford protein assay kit, such as that marketed by BioRad, according to the manufacturer's directions). Maximal protein release (indicating maximal lysis) from a concentrated suspension of intact ATCC No. 53968 bacteria was observed following 4–6 cycles of sonication (wherein one cycle comprises 30 seconds of sonication followed by a 30 second incubation on melting ice).

The preparation of lysed bacteria was then fractionated by centrifugation. A "cell debris" fraction (comprising cell wall fragments) was obtained as a pellet following centrifugation for 5 minutes at 6,000 xg. This fraction was demonstrated to contain biocatalytic desulfurization activity, as determined by Gibb's assay for the presence of 2-hydroxybiphenyl, the observed hydrocarbon product of oxidative biocatalytic desulfurization of DBT by ATCC No. 53968. The procedure for Gibb's assay was as follows:

Cell or cell fraction harvest

Cells or cell envelope fraction was centrifuged in a Sorvall GSA or ss34 rotor at 8,000 xg for 20 minutes at room temperature. The resulting pellet was washed in 0.05M phosphate buffer, pH 8.0, and resuspended in the same buffer. A sample was withdrawn and diluted 1:10 or 1:20 in phosphate buffer, and the optical absorbance of the suspension at 600 nm was determined. Thereafter, the volume was adjusted to yield a suspension having an $A_{600}$ in excess of 3.0, and preferably of about 4.0. This concentration was verified by withdrawing a sample, diluting it 1:10 and confirming its $A_{600}$ in the range of 0.300–0.400.

BDS incubation

Enzyme reactions were conducted in small flasks or large-diameter test tubes, which provide adequate volume for agitation/aeration. All reactions were in excess of about 5 mL. For each reaction, approximately 1 mg DBT was added per mL of cell or cell envelope suspension (a 5 mM addition of DBT to a 25 mL reaction requires 23 mg DBT; thus, reactions were adjusted to contain about 5 mM enzyme substrate). Reaction mixtures were transferred to a 30° C. water bath, and subjected to agitation at 200 rpm. It was noted that there is an initial lag in BDS activity; therefore, a zero time sample was considered optional. After 1, 2 and 3 hours of incubation, 1.5 mL samples were withdrawn from each reaction mixture and pelletted at about 12,000 rpm for 4 minutes in an Eppendorf microfuge. One milliliter samples of the resulting supernatants were transferred to 1.5 mL Eppendorf tubes for assay. It was found that these supernatant samples could be stored at 4° C. for several days prior to assay, if desired.

Gibb's assay 0.1 g Gibb's reagent (2,6-dichloro-quinone-4-chloroimide; obtained from Sigma Chemical Co.) was dissolved in 10 mL absolute ethanol in a test tube, and promptly protected from light by wrapping the tube in foil. This solution was prepared freshly each day. To each Eppendorf tube containing 1.0 mL supernatant adjusted to pH 8.0, 10 μL Gibb's reagent was added. After a 30 minute incubation at room temperature, the appearance of the blue product of reaction between Gibb's reagent and 2-HBP was monitored by measuring the increase in optical absorbance of the assay mixture at 610 nm, relative to the $A_{610}$ of a sample containing phosphate buffer rather than supernatant. Results were expressed as units of absorbance per hour, per unit of cell material (one unit of cell material is defined as the amount of cell/cell envelope suspension which, when suspended in water, yields an $A_{600}$ of 1.0).

Results of this study are summarized in Table 1.

TABLE 1

Biocatalytic Desulfurization by intact, lysed, and a cell-free fraction obtained from ATCC No. 53968

| Biocatalyst | Change in Absorbance (610 nm) per Hour per Cell Material | Number of Determinations |
|---|---|---|
| Washed intact cells | 0.085 ± 0.007 | n = 4 |
| Freeze-Thaw lysed cells (unfractionated) | 0.060 ± 0.001 | n = 2 |
| Sonicated lysed cells (cell debris fraction) | 0.035 ± 0.002 | n = 2 |

These results demonstrate that a substantial proportion of the total biocatalytic desulfurizing activity expressed by the ATCC No. 53968 microorganism is found in the "cell debris fraction", which contains external cell membrane and cell wall fragments. Thus, in the ATCC No. 53968 microorganism, the enzyme biocatalyst responsible for desulfurization is a component of the cell envelope (comprising the bacterial cell wall and cell membrane). Non-viable intact microorganisms can thus be used as the biocatalyst for BDS treatment, as can cell-free preparations that contain appropriate enzymatic activity.

Figure 4:
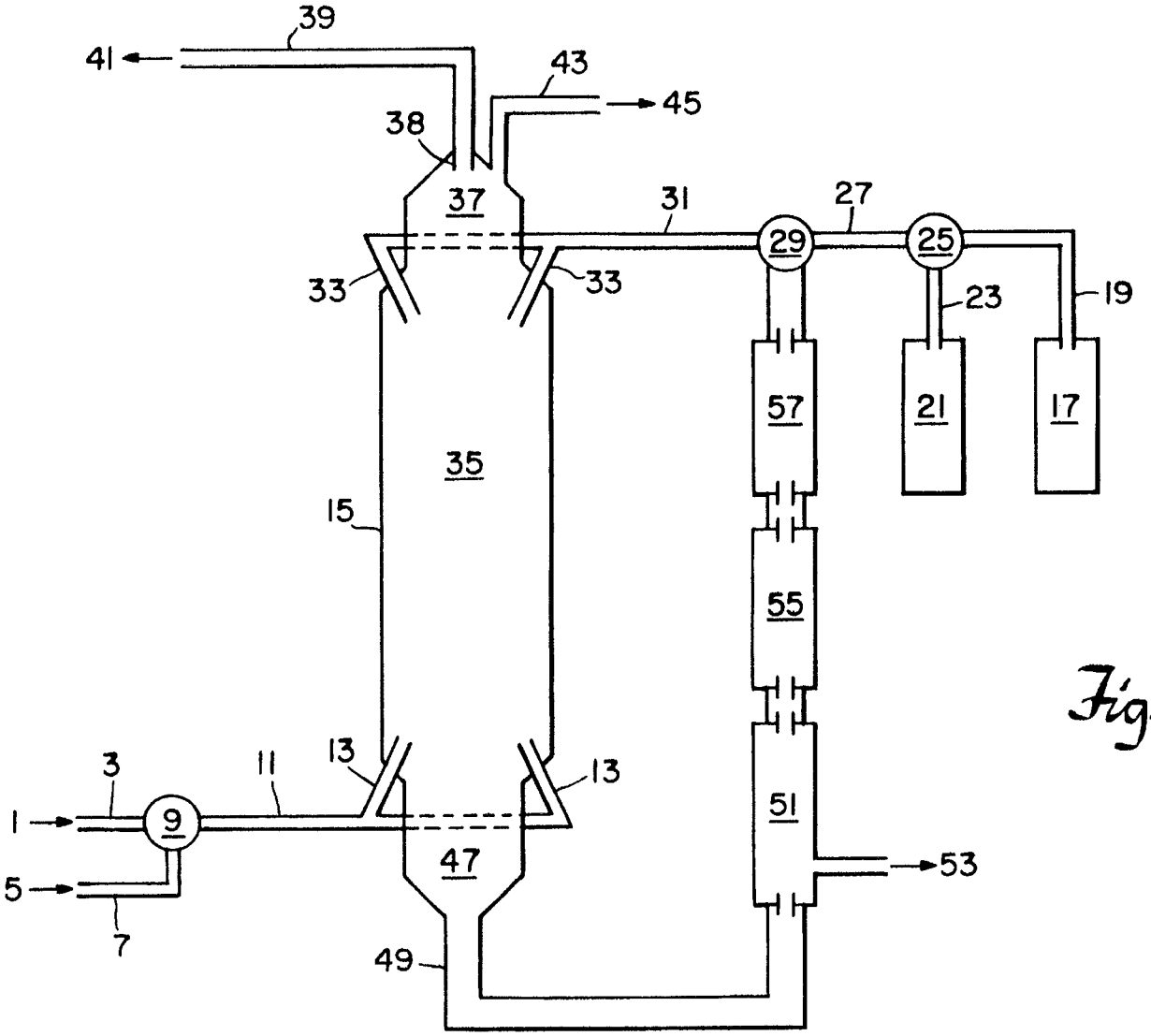
FIG. 4 is a schematic flow diagram of a preferred embodiment of the instant continuous process for biocatalytic desulfurization (BDS) of this invention.

FIG. 4 is a schematic flow diagram of the continuous process for biocatalytic desulfurization (BDS) of this invention. Liquid fossil fuel or petroleum liquid 1, in need of BDS treatment, enters through line 3. As discussed above and shown in FIG. 3, oxygen is consumed during biocatalytic desulfurization; accordingly, a source of oxygen (5) is introduced through line 7, and is contacted with said liquid fossil fuel or petroleum liquid 1 in mixing chamber 9 whereby oxygen tension in said liquid fossil fuel or petroleum liquid 1 is sufficiently increased to permit biocatalytic desulfurization to proceed. In this manner, the instant process allows the practitioner to capitalize on the greater capacity of liquid fossil fuel or petroleum (over aqueous liquids) to carry dissolved oxygen. For example, oxygen is ten times more soluble in octane than in water. Pollack, G. L., (1991) *Science* 251:1323–1330. Thus oxygen is more effectively delivered to the biocatalyst than it would be by, for example, sparging air into the reaction mixture during biocatalysis. In fact, direct sparging is to be avoided due to the tendency of such processes to produce explosive mixtures. Source of oxygen 5 can be oxygen-enriched air, pure oxygen, an oxygen-saturated perfluorocarbon liquid, etc. Oxygenated liquid fossil fuel or petroleum liquid thereafter passes through line 11 to injection ports 13, through which it enters reaction vessel 15.

An aqueous culture of the microbial biocatalytic agent of the present invention is prepared by fermentation in bioreactor 17, using culture conditions sufficient for the growth and biocatalytic activity of the particular micro-organism used. In order to generate maximal biocatalytic activity, it is important that the biocatalyst culture be maintained in a state of sulfur deprivation. This can be effectively accomplished by using a nutrient medium which lacks a source of inorganic sulfate, but is supplemented with DBT or a liquid petroleum sample with a high relative abundance of sulfur heterocycles. A particularly preferred microbial biocatalyst comprises a culture of mutant *Rhodoccus rodocrous* bacteria, ATCC No. 53968. This biocatalytic agent can advantageously be prepared by conventional fermentation techniques comprising aerobic conditions and a suitable nutrient medium which contains a carbon source, such as glycerol, benzoate, or glucose. When the culture has attained a sufficient volume and/or density, it is delivered from bioreactor 17 through line 19 to mixing chamber 25, where it is optionally supplemented with fresh, sulfur-free nutrient medium as necessary. This medium is prepared in chamber 21 and delivered to the mixing chamber 25 through line 23. The aqueous biocatalytic agent next passes through mixing chamber 29, and then through line 31, to injection ports 33. It is delivered through these ports into reaction vessel 15, optimally at the same time as the oxygenated liquid fossil fuel or petroleum liquid 1 is delivered through ports 13. The ratio of biocatalyst to liquid fossil fuel or petroleum liquid (substrate) can be varied widely, depending on the desired rate of reaction, and the levels and types of sulfur-bearing organic molecules present. Suitable ratios of biocatalyst to substrate can be ascertained by those skilled in the art through no more than routine experimentation. Preferably, the volume of biocatalyst will not exceed about one-tenth the total volume in the reaction vessel (i.e., the substrate accounts for at least about 9/10 of the combined volume).

Injection ports 13 and 33 are located at positions on the vessel walls conducive to the creation of a countercurrent flow within reaction vessel 15. In other words, mixing takes place within vessel 15 at central zone 35, as the lighter organic liquid fossil fuel or petroleum liquid substrate rises from injection ports 13 and encounters the heavier aqueous biocatalyst falling from injection ports 33. Turbulence and, optimally, an emulsion, are generated in zone 35, maximizing the surface area of the boundary between the aqueous and organic phases. In this manner, the biocatalytic agent is brought into intimate contact with the substrate fossil fuel or liquid petroleum; desulfurization proceeds relatively rapidly due to the high concentration of dissolved oxygen in the local environment of the aromatic sulfur-bearing heterocyclic molecules on which the ATCC No. 53968 biocatalyst acts. Thus, the only rate-limiting factor will be the availability of the sulfur-bearing heterocycles themselves.

The BDS process is most effective for the desulfurization of crude oils and petroleum distillate fractions which are capable of forming a transient or reversible emulsion with the aqueous biocatalyst in zone 35, as this ensures the production of a very high surface area between the two phases as they flow past each other. However, biocatalysis will proceed satisfactorily even in the absence of an emulsion, as long as an adequate degree of turbulence (mixing) is induced or generated. Optionally, means to produce mechanical or hydrodynamic agitation at zone 35 can be incorporated into the walls of the reaction vessel. Such means can also be used to extend the residence time of the substrate petroleum liquid in zone 35, the region in which it encounters the highest levels of BDS reactivity.

In addition, it is important that the reaction vessel be maintained at temperatures and pressures which are sufficient to maintain a reasonable rate of biocatalytic desulfurization. For example, the temperature of the vessel should be between about 10° C. and about 60° C.; ambient temperature (about 20° C. to about 30° C.) is preferred. However, any temperature between the pour point of the liquid fossil fuel or petroleum liquid and the temperature at which the biocatalyst is inactivated can be used. The pressure within the vessel should be at least sufficient to maintain an appropriate level of dissolved oxygen in the substrate fossil fuel or petroleum liquid. However, the pressure and turbulence within the vessel should not be so high as to cause shearing damage to the biocatalyst.

As a result of biocatalysis taking place in zone 35, the organic sulfur content of the liquid fossil fuel or petroleum liquid is reduced and the inorganic sulfate content of the aqueous biocatalyst is correspondingly increased. The substrate fossil fuel or petroleum liquid, having risen from ports 13 through BDS-reactive zone 35, collects at upper zone 37, the region of the reaction vessel located above the points at which aqueous biocatalyst is injected into the vessel (at ports 33). Conversely, the aqueous biocatalyst, being heavier than the fossil fuel or petroleum liquid, does not enter zone 37 to any significant extent. As the desulfurized fossil fuel or petroleum liquid collects in this region, it is drawn off or decanted from the reaction vessel at decanting port 38 from which it enters line 39. The desulfurized fossil fuel or petroleum liquid (41) delivered from line 39 is then subjected to any additional refining or finishing steps which may be required to produce the desired low-sulfur fuel product.

Optionally, any volatile exhaust gasses (45) which form in the headspace of the reaction vessel can be recovered through line 43. These gasses can be condensed, then burned in a manner sufficient to provide any heat which may be necessary to maintain the desired level of BDS-reactivity within the reaction vessel.

Similarly, after passing through injection ports 33 and falling through BDS-reactive zone 35, the aqueous biocatalyst collects in lower zone 47, below injection ports 13. The fossil fuel or petroleum liquid substrate entering from these injection ports does not tend to settle into zone 47 to any significant extent; being lighter than the aqueous phase, it rises into zone 35. As noted above, the biocatalyst collecting in zone 47 has acquired a significant level of inorganic sulfate as a result of its reactivity with the substrate petroleum liquid. Biocatalytic activity is depressed by the presence of inorganic sulfate, as this is a more easily assimilable form of sulfur for metabolic use than organic sulfur. Thus, the biocatalyst is said to be "spent". However, its activity can be regenerated by removing the inorganic sulfate from the biocatalytic agent, thereby restoring the ATCC No. 53968 biocatalyst to its initial sulfur-deprived state.

This is accomplished by retrieving the spent biocatalyst from the reaction vessel through line 49, and treating it in a manner sufficient to remove inorganic sulfate. The spent agent is first introduced into chamber 52, in which solids, sludges, excess hydrocarbons, or excess bacteria (live or dead), are removed from the aqueous biocatalyst and recovered or discarded (53). The aqueous biocatalyst next passes through chamber 55, and optional chamber 57, where it is contacted with an appropriate ion exchange resin or resins, such as an anion exchange resin and a cation exchange resin. Suitable ion exchange resins are commercially available; several of these are highly durable resins, including those linked to a rigid polystyrene support. These durable ion exchange resins are preferred. Two examples of polystyrene-supported resins are Amberlite IRA-400-OH (Rohm and Haas), and Dowex 1X8-50 (Dow Chemical Co.) Dowex MSA-1 (Dow Chemical Co.) is an example of a suitable non-polystyrene supported resin. The optimal ion exchange resin for use herein can be determined through no more than routine experimentation. Inorganic sulfate ions bind to the resin(s) and are removed from the aqueous biocatalytic agent. As a result, biocatalytic activity is regenerated.

Alternative means to remove aqueous sulfate and thereby regenerate biocatalytic activity can also be employed. Suitable alternatives to treatment with an ion exchange resin include, for example, treatment with an agent capable of removing sulfate ion by precipitation. Suitable agents include the salts of divalent cations such as barium chloride or calcium hydroxide. Calcium hydroxide is preferred due to the chemical nature of the sulfate-containing reaction product formed: calcium sulfate (gypsum), which can be readily separated from the aqueous biocatalyst. Other examples of suitable regeneration means include treatment with semi-permeable ion exchange membranes and electrodialysis.

Any of the above means for regenerating biocatalytic activity can be performed by treating the aqueous culture of the biocatalyst, or by initially separating (e.g., by sieving) the microbial biocatalyst from the aqueous liquid and treating the liquid alone, then recombining the biocatalyst with the sulfate-depleted aqueous liquid.

The regenerated aqueous biocatalyst proceeds to mixing chamber 29, where it is mixed with any fresh, sulfur-free nutrient medium (prepared in chamber 21) and/or any fresh ATCC No. 53968 culture (prepared in bioreactor 17), which may be required to reconstitute or replenish the desired level of biocatalytic activity.

The regenerated biocatalytic agent is delivered through line 31 to injection ports 33, where it reenters the reaction vessel (15) and is contacted with additional petroleum liquid in need of BDS treatment, entering the reaction vessel through injection ports 13 in the manner described previously. It is desirable to monitor and control the rates of reactants entering and products being removed from the reaction vessel, as maintaining substantially equivalent rates of entry and removal will maintain conditions (e.g., of pressure) sufficient for biocatalysis within the vessel. In this manner, a continuous stream of desulfurized petroleum liquid is generated, without the need to periodically pump the contents of the reaction vessel into a settling chamber where phase separation takes place, as described in Madkavkar, A. M. (1989) U.S. Pat. No. 4,861,723, and Kirshenbaum, I. (1961) U.S. Pat. No. 2,975,103, incorporated herein by reference.

The progress of BDS treatment of the petroleum liquid within the vessel can be monitored using conventional techniques, which are readily available to those skilled in the art. Baseline samples can be collected from the substrate before it is exposed to the biocatalyst, for example from sampling ports located at mixing chamber 9. Post-BDS samples can be collected from the desulfurized petroleum liquid which collects within the reaction vessel at zone 37, through sampling ports located in the vessel wall, or a sampling valve located at decanting port 38. The disappearance of sulfur from substrate hydrocarbons such as DBT can be monitored using a gas chromatograph coupled with mass spectrophotometric (GC/MS), nuclear magnetic resonance (GC/NMR), infrared spectrometric (GC/IR), or atomic emission spectrometric (GC/AES, or flame spectrometry) detection systems. Flame spectrometry is the preferred detection system, as it allows the operator to directly visualize the disappearance of sulfur atoms from combustible hydrocarbons by monitoring quantitative or relative decreases in flame spectral emissions at 392 nm, the wavelength characteristic of atomic sulfur. It is also possible to measure the decrease in total organic sulfur in the substrate fossil fuel, by subjecting the unchromatographed samples to flame spectrometry. If the extent of desulfurization is insufficient, the desulfurized petroleum liquid collected from line 39 can optionally be reintroduced through line 3 and subjected to an additional cycle of BDS treatment. Alternatively, it can be subjected to an alternative desulfurization process, such as HDS.

EQUIVALENTS

Those skilled in the art will recognize, or be able to ascertain using no more than routine experimentation, many equivalents to the specific embodiments of the invention described herein. These and all other such equivalents are intended to be encompassed by the following claims.

I claim:

1. A continuous process for desulfurizing a liquid fossil fuel which contains organic sulfur molecules, a significant portion of which are sulfur-bearing heterocycles having carbon-sulfur bonds, comprising the steps of:

(a) contacting the liquid fossil fuel with a source of oxygen under conditions sufficient to increase the oxygen tension in the liquid fossil fuel;

(b) introducing the oxygenated liquid fossil fuel to a reaction vessel while simultaneously introducing an aqueous, sulfur-deprived biocatalytic agent to the reaction vessel at a site spatially distinct from the site of introduction of the oxygenated liquid fossil fuel, in such a fashion as to create a countercurrent flow system within the vessel, the biocatalytic agent comprising one or more bacterial organisms expressing an enzyme or enzymes that catalyze the sulfur-specific oxidative cleavage of carbon-sulfur bonds in sulfur-bearing heterocycles to produce desulfurized organic molecules and inorganic sulfur ions;

(c) incubating the oxygenated liquid fossil fuel with the biocatalytic agent in the reaction vessel under conditions sufficient for selective biocatalytic oxidative cleavage of said carbon-sulfur bonds in said sulfur-bearing heterocycles, whereby the organic sulfur content of the liquid fossil fuel is significantly reduced, a significant amount of water-soluble inorganic sulfur ions are generated and a portion of the biocatalytic agent becomes spent;

(d) removing the desulfurized liquid fossil fuel from the reaction vessel by decanting it from the upper region of the vessel;

(e) removing the spent aqueous biocatalytic agent from the reaction vessel by recovering it from the lower region of the vessel, the spent agent being significantly enriched in inorganic sulfur;

(f) treating the inorganic sulfur-enriched aqueous biocatalytic agent in a manner sufficient for the removal of a substantial amount of the inorganic sulfur from the agent, whereby the biocatalytic activity of the agent is regenerated; and (g) introducing the regenerated aqueous biocatalytic agent to the reaction vessel while simultaneously introducing thereto the oxygenated liquid fossil fuel, in such a fashion as to maintain countercurrent flow.

2. The method of claim 1 wherein the liquid fossil fuel is capable of forming a transient or reversible emulsion with the aqueous biocatalytic agent, whereby an emulsion zone is produced in the reaction vessel, said emulsion zone being bound above by a zone enriched in desulfurized liquid fossil fuel, and bounded below by a zone enriched in spent inorganic sulfur-enriched aqueous biocatalytic agent.

3. The method of claim 2 wherein the formation or maintenance of the emulsion zone is accomplished with the assistance of mechanical or hydrodynamic agitation.

4. The method of claim 2 wherein said regenerated inorganic sulfur-depleted aqueous biocatalytic agent is introduced to the reaction vessel at or close to the boundary between the desulfurized liquid fossil fuel zone and the emulsion zone, and said oxygenated liquid fossil fuel is introduced to the reaction vessel at or close to the boundary between the emulsion zone and the spent aqueous biocatalytic agent zone.

5. The method of claim 4 wherein the rates of addition of reactants to and removal of products from the reaction vessel are monitored and controlled such that the rates thereof are substantially equivalent, the reactants comprising petroleum liquid as said oxygenated liquid fossil fuel and the regenerated aqueous biocatalytic agent, and the products comprising desulfurized petroleum liquid and the spent aqueous biocatalytic agent.

6. The method of claim 1 wherein the aqueous biocatalytic agent is a culture of Rhodococcus bacteria, ATCC No. 53968.

7. The method of claim 6 wherein the regeneration of the aqueous biocatalytic agent comprises both (a) the removal of a significant number of said inorganic sulfur ions; and (b) the addition of nutrients and/or said culture as required to maintain sufficient biocatalytic activity in the regenerated agent.

8. The method of claim 7 wherein the removal of said sulfur ions is accomplished by contacting the spent aqueous biocatalytic agent with a resin capable of binding said ions, under conditions sufficient for the binding of said ions to the resin.

9. The method of claim 1 wherein the removal of said sulfur ions is accomplished by contacting the spent aqueous biocatalytic agent with a resin capable of binding said ions, under conditions sufficient for the binding of said ions to the resin.

10. The method of claim 1 including the additional step of trapping and condensing any volatile, flammable exhaust gasses escaping from the reaction vessel during the removal of the desulfurized liquid fossil fuel, and burning the same in a manner sufficient to provide any heat necessary to promote biocatalytic activity within the reaction vessel.

11. The method of claim 1 wherein said reaction vessel is vertically elongated.

12. The method of claim 1 wherein the liquid fossil fuel is petroleum liquid.

13. A continuous process for desulfurizing a liquid fossil fuel which contains organic sulfur molecules, a significant proportion of which are sulfur-bearing aromatic heterocycles having carbon-sulfur bonds, said liquid fossil fuel being capable of forming a reversible emulsion with an aqueous phase, comprising the steps of:

(a) contacting said liquid fossil fuel with a source of oxygen under conditions sufficient to increase the oxygen tension therein;

(b) introducing the oxygenated liquid fossil fuel to a reaction vessel while simultaneously introducing an aqueous, sulfur-deprived biocatalytic agent to the reaction vessel at a site spatially distinct from the site of introduction of the oxygenated liquid fossil fuel, in such a fashion as to create a countercurrent flow system within the reaction vessel, the biocatalytic agent comprising one or more bacterial organisms expressing an enzyme or enzymes that catalyze the sulfur-specific oxidative cleavage of carbon-sulfur bonds in sulfur-bearing heterocycles to produce desulfurized organic molecules and inorganic sulfur ions;

(c) incubating the oxygenated liquid fossil fuel with the biocatalytic agent in the reaction vessel under conditions sufficient for selective biocatalytic cleavage of said carbon-sulfur bonds in said sulfur-bearing heterocycles, whereby the organic sulfur content of the liquid fossil fuel is significantly reduced, a significant amount of water-soluble inorganic sulfur ions are generated and a portion of the biocatalytic agent becomes spent, said conditions comprising the formation of a zone of reversible emulsion of the oxygenated liquid fossil fuel and the aqueous biocatalytic agent, bounded above by a zone enriched in biocatalytically desulfurized liquid fossil fuel and bounded below by a zone enriched in spent inorganic sulfur-enriched aqueous biocatalytic agent;

(d) decanting the desulfurized liquid fossil fuel from the vessel through a decanting port located at a site of the vessel wall corresponding to the region occupied by the zone enriched in biocatalytically desulfurized liquid fossil fuel, while retrieving the spent aqueous biocatalytic agent from the vessel through a recovery port located at a site of the vessel wall corresponding to the region occupied by the zone enriched in spent aqueous biocatalytic agent;

(e) regenerating the spent biocatalytic agent by:

(i) treating it with a substance capable of substantially decreasing the concentration of inorganic sulfur ions in an aqueous livid in such a manner and for such a period of time that the aqueous biocatalytic agent becomes sulfur-deprived, and (ii) adding nutrients and/or the biocatalytic agent as required to maintain sufficient biocatalytic activity in the regenerated biocatalytic agent; and (f) introducing the regenerated aqueous biocatalytic agent to the reaction vessel while simultaneously introducing thereto the oxygenated liquid fossil fuel, in such a fashion as to maintain countercurrent flow and a zone of reversible emulsion within the reaction vessel.

14. The method of claim 13 including the additional steps of:

(a) trapping and condensing any volatile, flammable exhaust gasses escaping from the reaction vessel during the decanting of the biocatalytically desulfurized liquid fossil fuel; and (b) burning the condensed exhaust gasses in a manner sufficient to provide any heat which may be necessary to promote a sufficient level of biocatalytic activity in the reaction vessel.

15. The method of claim 13 wherein the aqueous biocatalytic agent is a culture of Rhodococcus bacteria, ATCC No. 53968.

16. The method of claim 13 wherein said reaction vessel is vertically elongated.

17. The method of claim 13 wherein the liquid fossil fuel is petroleum liquid.

18. A continuous process for desulfurizing a liquid fossil fuel which contains organic sulfur molecules, a significant proportion of which are sulfur-bearing aromatic heterocycles having carbon-sulfur bonds, said liquid fossil fuel being capable of forming a reversible emulsion with an aqueous phase, comprising the steps of:

(a) contacting the liquid fossil fuel with a source of oxygen under conditions sufficient to increase the oxygen tension therein;

(b) introducing the oxygenated liquid fossil fuel to a vertically elongated reaction vessel while simultaneously introducing an aqueous, sulfur-deprived biocatalytic agent to the reaction vessel at a site spatially distinct from the site of introduction of the oxygenated liquid fossil fuel, in such a fashion as to create a countercurrent flow system within the reaction vessel, the biocatalytic agent comprising Rhodococcus bacteria, ATCC No. 53968;

(c) incubating the oxygenated liquid fossil fuel with the biocatalytic agent in the reaction vessel under conditions sufficient for selective biocatalytic cleavage of said carbon-sulfur bonds in said sulfur-bearing heterocycles, whereby the organic sulfur content of liquid fossil fuel is significantly reduced, a significant amount of water-soluble inorganic sulfur ions are generated and a portion of the biocatalytic agent becomes spent, said conditions comprising the formation of a zone of reversible emulsion of the oxygenated liquid fossil fuel and the aqueous biocatalytic agent, bounded above by a zone enriched in biocatalytically desulfurized liquid fossil fuel and bounded below by a zone enriched in spent inorganic sulfur-enriched aqueous biocatalytic agent;

(d) decanting the desulfurized liquid fossil fuel from the vessel through a decanting port located at a site of the vessel wall corresponding to the region occupied by the zone enriched in biocatalytically desulfurized liquid fossil fuel, while retrieving the spent biocatalytic agent from the vessel through a recovery port located at a site of the vessel wall corresponding to the region occupied by the zone enriched in spent aqueous biocatalytic agent;

(e) regenerating the spent biocatalytic agent by:

(i) treating it with a substance capable of substantially decreasing the concentration of inorganic sulfur ions in an aqueous liquid in such a manner and for such a period of time that the aqueous biocatalytic agent becomes sulfur-deprived, and (ii) adding nutrients and/or the biocatalytic agent as required to maintain sufficient biocatalytic activity in the regenerated biocatalytic agent; and (f) introducing the regenerated aqueous biocatalytic agent to the reaction vessel while simultaneously introducing thereto the oxygenated liquid fossil fuel, in such a fashion as to maintain countercurrent flow and a zone of reversible emulsion within the reaction vessel.

19. A continuous process for desulfurizing a liquid fossil fuel which contains organic sulfur molecules, a significant portion of which are sulfur-bearing heterocycles having carbon-sulfur bonds, comprising the steps of:

(a) contacting the liquid fossil fuel with a source of oxygen under conditions sufficient to increase the oxygen tension in the liquid fossil fuel;

(b) introducing the oxygenated liquid fossil fuel to a reaction vessel while simultaneously introducing an aqueous, sulfur-deprived biocatalytic agent to the reaction vessel at a site spatially distinct from the site of introduction of the oxygenated liquid fossil fuel, in such a fashion as to create a countercurrent flow system within the vessel, the biocatalytic agent comprising a bacterial cell free extract comprising one or more enzymes that catalyze the sulfur-specific oxidative cleavage of carbon-sulfur bonds in sulfur-bearing heterocycles to produce desulfurized organic molecules and inorganic sulfur ions;

(c) incubating the oxygenated liquid fossil fuel with the biocatalytic agent in the reaction vessel under conditions sufficient for selective biocatalytic oxidative cleavage of said carbon-sulfur bonds in said sulfur-bearing heterocycles, whereby the organic sulfur content of the liquid fossil fuel is significantly reduced, a significant amount of water-soluble inorganic sulfur ions are generated and a portion of the biocatalytic agent become spent;

(d) removing the desulfurized liquid fossil fuel from the reaction vessel by decanting it from the upper region of the vessel;

(e) removing the spent aqueous biocatalytic agent from the reaction vessel by recovering it from the lower region of the vessel, the spent agent being significantly enriched in inorganic sulfur;

(f) treating the inorganic sulfur-enriched aqueous biocatalytic agent in a manner sufficient for the removal of a substantial amount of the inorganic sulfur from the agent, whereby the biocatalytic activity of the agent is regenerated; and (g) introducing the regenerated aqueous biocatalytic agent to the reaction vessel while simultaneously introducing thereto the oxygenated liquid fossil fuel, in such a fashion as to maintain countercurrent flow.

20. The method of claim 19 wherein the liquid fossil fuel is capable of forming a transient or reversible emulsion with the aqueous biocatalytic agent, whereby an emulsion zone is produced in the reaction vessel, said emulsion zone being bound above by a zone enriched in desulfurized liquid fossil fuel, and bounded below by a zone enriched in spent inorganic sulfur-enriched aqueous biocatalytic agent.

21. The method of claim 20 wherein the formation or maintenance of the emulsion zone is accomplished with the assistance of mechanical or hydrodynamic agitation.

22. The method of claim 20 wherein said regenerated inorganic sulfur-depleted aqueous biocatalytic agent is introduced to the reaction vessel at or close to the boundary between the desulfurized liquid fossil fuel zone and the emulsion zone, and said oxygenated liquid fossil fuel is introduced to the reaction vessel at or close to the boundary between the emulsion zone and the spent aqueous biocatalytic agent zone.

23. The method of claim 22 wherein the rates of addition of reactants to and removal of products from the reaction vessel are monitored and controlled such that the rates thereof are substantially equivalent, the reactants comprising petroleum liquid as said oxygenated liquid fossil fuel and the regenerated aqueous biocatalytic agent, and products comprising desulfurized petroleum liquid and the spent aqueous biocatalytic agent.

24. The method of claim 19 wherein the removal of said sulfur ions is accomplished by contacting the spent aqueous biocatalytic agent with a resin capable of binding said ions, under conditions sufficient for the binding of said ions to the resin.

25. The method of claim 19 wherein the biocatalytic agent is a cell-free extract derived from Rhodococcus bacteria ATCC No. 53968.

26. The method of claim 19 wherein the cell-free extract is bound to a carrier.

27. The method of claim 19 including the additional step of trapping and condensing any volatile, flammable exhaust gasses escaping from the reaction vessel during the removal of the desulfurized liquid fossil fuel, and burning the same in a manner sufficient to provide any heat necessary to promote biocatalytic activity within the reaction vessel.

28. The method of claim 19 wherein said reaction vessel is vertically elongated.

29. The method of claim 19 wherein the liquid fossil fuel is petroleum liquid.

30. A continuous process for desulfurizing a liquid fossil fuel which contains organic sulfur molecules, a significant proportion of which are sulfur-bearing aromatic heterocycles having carbon-sulfur bonds, said liquid fossil fuel being capable of forming a reversible emulsion with an aqueous phase, comprising the steps of:

(a) contacting said liquid fossil fuel with a source of oxygen under conditions sufficient to increase the oxygen tension therein;

(b) introducing the oxygenated liquid fossil fuel to a reaction vessel while simultaneously introducing an aqueous, sulfur-deprived biocatalytic agent to the reaction vessel at a site spatially distinct from the site of introduction of the oxygenated liquid fossil fuel, in such a fashion as to create a countercurrent flow system within the reaction vessel, the biocatalytic agent comprising a bacterial cell free extract comprising one or more enzymes that catalyze the sulfur-specific oxidative cleavage of carbon-sulfur bonds in sulfur-bearing heterocycles to produce desulfurized organic molecules and inorganic sulfur ions;

(c) incubating the oxygenated liquid fossil fuel with the biocatalytic agent in the reaction vessel under conditions sufficient for selective biocatalytic cleavage of said carbon-sulfur bonds in said sulfur-bearing heterocycles, whereby the organic sulfur content of the liquid fossil fuel is significantly reduced, a significant amount, of water-soluble inorganic sulfur ions are generated and a portion of the biocatalytic agent becomes spent, said conditions comprising the formation of a zone of reversible emulsion of the oxygenated liquid fossil fuel and the aqueous biocatalytic agent, bounded above by a zone enriched in biocatalytically desulfurized liquid fossil fuel and bounded below by a zone enriched in spent inorganic sulfur-enriched aqueous biocatalytic agent;

(d) decanting the desulfurized liquid fossil fuel from the vessel through a decanting port located at a site of the vessel wall corresponding to the region occupied by the zone enriched in biocatalytically desulfurized liquid fossil fuel, while retrieving the spent aqueous biocatalytic agent from the vessel through a recovery port located at a site of the vessel wall corresponding to the region occupied by the zone enriched in spent aqueous biocatalytic agent;

(e) regenerating the spent biocatalytic agent by:

(i) treating it with a substance capable of substantially decreasing the concentration of inorganic sulfur ions in an aqueous liquid in such a manner and for such a period of time that the aqueous biocatalytic agent becomes sulfur-deprived, and (ii) adding nutrients and/or the biocatalytic agent as required to maintain sufficient biocatalytic activity in the regenerated biocatalytic agent; and (f) introducing the regenerated aqueous biocatalytic agent to the reaction vessel while simultaneously introducing thereto the oxygenated liquid fossil fuel, in such a fashion as to maintain countercurrent flow and a zone of reversible emulsion within the reaction vessel.

31. The method of claim 30 including the additional steps of:

(a) trapping and condensing any volatile, flammable exhaust gasses escaping from the reaction vessel during the decanting of the biocatalytically desulfurized liquid fossil fuel; and (b) burning the condensed exhaust gasses in a manner sufficient to provide any heat which may be necessary to promote a sufficient level of biocatalytic activity in the reaction vessel.

32. The method of claim 30 wherein the aqueous biocatalytic agent is a cell-free extract derived from Rhodococcus bacteria, ATCC No. 53968.

33. The method of claim 30 wherein the cell-free extract is bound to a carrier.

34. The method of claim 30 wherein said reaction vessel is vertically elongated.

35. The method of claim 30 wherein the liquid fossil fuel is petroleum liquid.

36. A continuous process for desulfurizing a liquid fossil fuel which contains organic sulfur molecules, a significant proportion of which are sulfur-bearing aromatic heterocycles having carbon-sulfur bonds, said liquid fossil fuel being capable of forming a reversible emulsion with an aqueous phase, comprising the steps of:

(a) contacting the liquid fossil fuel with a source of oxygen under conditions sufficient to increase the oxygen tension therein;

(b) introducing the oxygenated liquid fossil fuel to a vertically elongated reaction vessel while simultaneously introducing an aqueous, sulfur-deprived biocatalytic agent to the reaction vessel at a site spatially distinct from the site of introduction of the oxygenated liquid fossil fuel, in such a fashion as to create a countercurrent flow system within the reaction vessel, the biocatalytic agent comprising a cell free extract comprising enzymes derived from Rhodococcus bacteria, ATCC No. 53968;

(c) incubating the oxygenated liquid fossil fuel with the biocatalytic agent in the reaction vessel under conditions sufficient for selective biocatalytic cleavage of said carbon-sulfur bonds in said sulfur-bearing heterocycles, whereby the organic sulfur content of the liquid fossil fuel is significantly reduced, a significant amount of water-soluble inorganic sulfur ions are generated and a portion of the biocatalytic agent becomes spent, said conditions comprising the formation of a zone of reversible emulsion of the oxygenated liquid fossil fuel and the aqueous biocatalytic agent, bounded above by a zone enriched in biocatalytically desulfurized liquid fossil fuel and bounded below by a zone enriched in spent inorganic sulfur-enriched aqueous biocatalytic agent;

(d) decanting the desulfurized liquid fossil fuel from the vessel through a decanting port located at a site of the vessel wall corresponding to the region occupied by the zone enriched in biocatalytically desulfurized liquid fossil fuel, while retrieving the spent biocatalytic agent from the vessel through a recovery port located at a site of the vessel wall corresponding to the region occupied by the zone enriched in spent aqueous biocatalytic agent;

(e) regenerating the spent biocatalytic agent by (i) treating it with a substance capable of substantially decreasing the concentration of inorganic sulfur ions in an aqueous liquid in such a manner and for such a period of time that the aqueous biocatalytic agent becomes sulfur-deprived, and (ii) adding nutrients and/or the biocatalytic agent as required to maintain sufficient biocatalytic activity in the regenerated biocatalytic agent; and (f) introducing the regenerated aqueous biocatalytic agent to the reaction vessel while simultaneously introducing thereto the oxygenated liquid fossil fuel, in such a fashion as to maintain countercurrent flow and a zone of reversible emulsion within the reaction vessel.

* * * * *

UNITED STATES PATENT AND TRADEMARK OFFICE

CERTIFICATE OF CORRECTION

PATENT NO. : 5,472,875

DATED : December 5, 1995

INVENTOR(S) : Daniel J. Monticello

It is certified that error appears in the above-identified patent and that said Letters Patent is hereby corrected as shown below:

In Column 19, line 27, delete "livid" and insert therefor --liquid--.

Signed and Sealed this

Twenty-sixth Day of March, 1996

Bruce Lehman

*Attest:*

BRUCE LEHMAN

*Attesting Officer*

*Commissioner of Patents and Trademarks*